United States Patent [19]

Schoch et al.

[11] 4,375,785

[45] Mar. 8, 1983

[54] METHOD AND APPARATUS FOR ACHIEVING THERMAL STABILITY IN A PRESS

[75] Inventors: Daniel A. Schoch, Minster; Terry L. Wissman, New Bremen, both of Ohio

[73] Assignee: The Minster Machine Company, Minster, Ohio

[21] Appl. No.: 299,833

[22] Filed: Sep. 8, 1981

[51] Int. Cl.[3] ..... B30B 13/00; B30B 15/04

[52] U.S. Cl. ..... 100/35; 62/DIG. 10; 72/455; 74/606 A; 83/170; 100/214; 100/282; 165/47; 184/104 R

[58] Field of Search ..... 100/35, 38, 214, 282, 100/292, 258 A, 258 R; 184/6.22, 104 R; 83/170; 82/DIG. 1; 74/606 A; 62/DIG. 10; 165/47; 72/455

[56] References Cited

U.S. PATENT DOCUMENTS

| | | | |
|---|---|---|---|
| 2,279,569 | 4/1942 | Jelinek et al. | 82/DIG. 1 |
| 2,326,638 | 8/1943 | Groene et al. | 82/DIG. 1 |
| 2,430,127 | 11/1947 | Kronenberg et al. | 62/DIG. 10 |
| 2,606,747 | 8/1952 | Williams | 184/104 R X |
| 3,303,731 | 2/1967 | Zawistowski | 82/DIG. 1 |
| 3,508,430 | 4/1970 | Edmonson | 100/214 X |
| 3,858,432 | 1/1975 | Voorhees et al. | 72/455 |
| 3,994,367 | 11/1976 | Christ | 184/6.22 X |

*Primary Examiner*—Billy J. Wilhite

*Attorney, Agent, or Firm*—Albert L. Jeffers; John F. Hoffman

[57] ABSTRACT

The invention relates to a mechanical press and in particular to a means for achieving thermal stability, particularly shutheight stability, by utilizing the waste heat from lubricant circulated through the drive assembly to heat the uprights. The oil is circulated through the crankshaft and connection arm assembly in the crown and then caused to flow through a thermal transfer device mounted to each of the uprights wherein the heated oil transfers a portion of its heat to the uprights so that they elongate due to thermal expansion at the same rate as the connection arms. The thermal transfer devices comprise a plurality of baffles over and through which the oil flows under gravity or pressure, wherein the baffles cause the oil to form a plurality of vertically spaced pools in good thermal contact with the uprights. By adjusting the baffle structure so that the oil flows downwardly at a higher or lower rate, the amount of thermal transfer can be adjusted to ensure that equal thermal growth of the uprights and connections occurs.

17 Claims, 12 Drawing Figures

METHOD AND APPARATUS FOR ACHIEVING THERMAL STABILITY IN A PRESS

BACKGROUND OF THE INVENTION

The present invention relates to a mechanical press of the type used for metal stamping and forming, and in particular to a method and apparatus for maintaining a constant shutheight by compensating for thermal growth of the connections.

Conventional mechanical presses comprise a bed which is mounted to a platform or the floor of the shop, a vertically spaced crown portion in which the drive assembly is contained, and one or more uprights rigidly connected to the bed and crown and maintaining the bed and crown in vertically spaced relationship. The crown contains the drive assembly, which typically comprises a crankshaft having one or more eccentrics thereon and connection arms connected to the eccentrics of the crankshaft at their upper ends and to the slide at their lower ends. The slide is mounted within the uprights for vertical reciprocating motion and may be guided in a number of ways, such as by gibs on the uprights themselves or on guideposts rigidly connected to the bed and crown.

At one end of the crankshaft there may be mounted a flywheel and clutch assembly wherein the flywheel is connected by a belt to the output pulley of a motor so that when the motor is energized, the massive flywheel rotates. When the clutch is energized, the rotary motion of the flywheel is transmitted to the crankshaft thereby causing the connection arms to undergo rotary-oscillatory motion that is transmitted to the slide assembly by means of a wrist pin, for example, so that the rotary-oscillatory motion is converted to straight reciprocating motion. These slides reciprocate in the generally vertical direction or in a slightly inclined direction in the case of an open back inclined press thereby causing the die mounted to the slide to engage stock fed into the press on each downward movement of the slide. The other half of the die set is mounted to a bolster which in turn is mounted to the bed of the press.

As the press operates, frictional heat is generated at each place where there is an interface between two moving parts. Examples of sources of frictional heat include the motion between the crankshaft eccentrics and the connection bearings between the crankshaft and the connection arm bearing for the dynamic balancer weight, between the crankshaft and the main bearings, and between the guideposts and their associated bushings. Although much of this heat is dissipated by the oil recirculation system and directly to the ambient, the press itself, particularly the elements of the drive assembly, experience an increase in temperature. This temperature increase is particularly troublesome with regard to the connections between the crankshaft and the slide because the increase in temperature results in a thermal expansion of the connections thereby increasing their length. As the connections increase in length, the shutheight of the press, which is the distance between the slide and bolster at the bottom of the slide stroke, decreases.

If the press shutheight is adjusted to the desired level when the press is cold, then as the press warms up, faulty parts will be produced because of the overextension of the stroke. Conversely, if the press shutheight is adjusted for operating temperatures, then faulty parts will be produced during the thermal warmup period.

When performing precision coining and embossing operations, strict maintenance of the press shutheight is imperative. Although the press can be run for a period of time to warm it up to the normal operating temperature, this may require several hours and needlessly expends energy. Interim adjustments in the press shutheight could be made during operation, but this would result in considerable press down time with a concomitant loss of production.

By causing the press uprights to elongate at the same rate as the connections, the thermal growth of the connections could be compensated for and the press shutheight would remain stable. Although the press uprights increase in temperature over time as the press warms up, they do so at a much lower rate than the connections due to their substantially larger mass and exposure to the ambient. Furthermore, the uprights are located at positions remote from the source of the frictional heat, which is generated primarily by the drive assembly located in the crown.

One prior attempt to cause the uprights to elongate in order to compensate for the thermal growth of the connections comprises placing in the uprights thermal heaters of the electrical resistance type. In addition to causing a potential fire hazard or the danger of burns to the operator, the electric heaters were not satisfactory because of the control circuitry necessary to regulate their operation. Because the connections can heat up at different rates depending on the ambient temperature, the effects of the press sound enclosure, and the like, it would be necessary to monitor the temperature of the connections or the shutheight and then regulate the electric heaters accordingly. Due to the existence of a number of points at which malfunctions could occur, systems of this type have not proven to be satisfactory. An additional drawback is that they require an external source of energy to energize the electric resistance heaters.

The problem which has occurred in the past in connection with presses of the general type described above is that of lateral expansion of the crown area at a rate faster than the expansion of the bed. Since the crown contains the moving parts and the oil circulation, it will naturally expand at a higher rate than will the bed, which contains few, if any, moving parts. The effect of this uneven expansion was to disrupt the parallelism of the gib surfaces on which the slide was guided. The solution utilized to overcome this problem was to pump oil from the crown down into the bed so that it would also experience thermal expansion thereby alleviating the gib surface misalignment.

SUMMARY OF THE INVENTION

In order to compensate for the effects of thermal growth of the connections in a mechanical press, the present invention provides a method and apparatus for utilizing the waste heat produced by the friction between parts in the drive and guide assemblies to increase the temperature of the uprights. Specifically, oil is circulated into contact with the various components of the drive and guide assemblies, such as the crankshaft, slide connections, counterweight connection, main bearing blocks, and counterweight guide pins, and this oil is collected in a sump in the lower portion of the crown crank cavity. Oil is also pumped through the main guideposts for the slide, and this oil together with the oil collected in the crown sump is fed by gravity to a plurality of thermal exchange devices located within the uprights of the press.

In a specific embodiment of the invention, the oil is directed to a cascade-type thermal exchanger which comprises a plurality of vertically spaced baffles causing the hot oil to form a succession of pools in good thermal contact with the respective uprights and then drip from one pool to the next lower pool until it is eventually collected in a sump in the bed. The collected oil is then pumped upwardly to the crown for recirculation through the drive and guide assemblies. The baffles of the cascade thermal exchangers are fastened directly to the uprights so that the oil collected from the crown area is brought into direct thermal contact with the uprights so that the uprights absorb a portion of the heat and experience a gradual rise in temperature. In order to prevent the oil from forming stagnant pools, holes are provided in the baffles so that oil is continuously flowing downwardly through the heat exchangers and into the sump in the bed.

The advantage to the system of the present invention is that, unlike the prior art electrical heaters, no external control circuitry is necessary to regulate the amount of heat imparted to the uprights by the heaters. Since the same oil is circulated through the driving assembly including the connection arms as is brought into thermal contact with the uprights, there is a natural correlation between the amount of heat imparted to the connections and to the uprights. If, in a certain instance, the connections would heat up more rapidly than is normal, such as due to a higher than normal ambient, this same faster rise in temperature would be experienced by the circulating oil. Since this same oil is then channeled directly to the uprights, the uprights themselves would be heated more rapidly so that their thermal growth would match that of the connections. Thus, once calibrated, the system is self-regulating.

The amount of heat transfer to the uprights can be very accurately regulated at the time the press is manufactured by modifying one or more of the physical parameters in the thermal exchanger. For example, by increasing the diameters or number of the openings in the baffles, the oil will be caused to flow more rapidly from one pool to the next. Alternatively, or in addition thereto, the number and spacing of the baffles can be modified so that there is more or less contact between the hot oil and the surfaces of the uprights, or the shape of the baffles can be modified so that a portion of the oil drips down without ever contacting the uprights and only a lesser portion is caused to pool. Once the system is fine tuned so that the proper portion of the heat in the oil is transferred to the uprights, then no further regulation by the user will be necessary, in most cases. This avoids the necessity for making manual adjustments to a control circuit for monitoring physical values, such as shutheight, as would be the case with the electric heaters for the uprights.

Finally, the system is energy efficient because it utilizes the waste heat of the oil heated by the viscous shear of the oil in the bearings in the crown, as opposed to electric heaters which require an external source of power.

Although the cascade-type thermal exchanger is preferred, other techniques for achieving thermal exchange between the oil and uprights could be used. For example, the oil could be flowed through passageways within the uprights before reaching the sump in the bed. The disadvantage to this technique, however, is that it would be difficult to calabrate and fine tune at the time the press is built or later in a user's factory, if such would be necessary. With the cascade baffle arrangement, on the other hand, calabration and fine tuning is relatively easy either by modifying the baffle structure itself or by removing the baffle and substituting a different one in its place. The heat exchange chambers are located on the outer surfaces of the respective uprights so that they are readily accessible if it should become necessary to change the baffle plates.

Specifically, the present invention relates to a mechanical press having a bed, a crown, at least two uprights connecting the crown to the bed, a slide mounted for reciprocal movement between the crown and the bed, a crankshaft and connection arm assembly mounted in the crown, the assembly comprising a rotatable crankshaft and at least one connection arm connected to the crankshaft and driven thereby. The connection arm is connected to the slide, preferably by means of a piston and wrist pin assembly. A lubricant is circulated in the crown into contact with the crankshaft and connection arm assembly whereby the lubricant is heated by frictional heat generated by the crankshaft and connection arm assembly. The lubricant is then flowed to thermal transfer devices on the uprights whereupon a portion of the waste heat in the lubricant is transferred to the uprights in an amount to cause the uprights to elongate due to thermal growth at approximately the same rate as the connection arm elongates due to thermal growth.

It is an object of the present invention to provide a means for achieving shutheight stability in a mechanical press wherein heated lubricant from the crown portion of the press is circulated through a thermal transfer device in the uprights to cause the uprights to elongate due to thermal expansion at the same rate as the connections.

A further object of the present invention is to provide such a shutheight stability system wherein waste heat generated by frictional forces in the crown is utilized as the source of heat to increase the temperature of the uprights.

A still further object of the present invention is to provide a system for thermal stability in a press which does not require an external source of energy.

Yet another object of the present invention is to provide a system for causing the uprights and connections to thermally expand at the same rate wherein the system is self-regulating without the necessity of an external control circuit.

These and other objects of the present invention will be apparent from the detailed description considered together with the appropriate drawing figures.

DETAILED DESCRIPTION OF A PREFERRED EMBODIMENT

Figure 1:
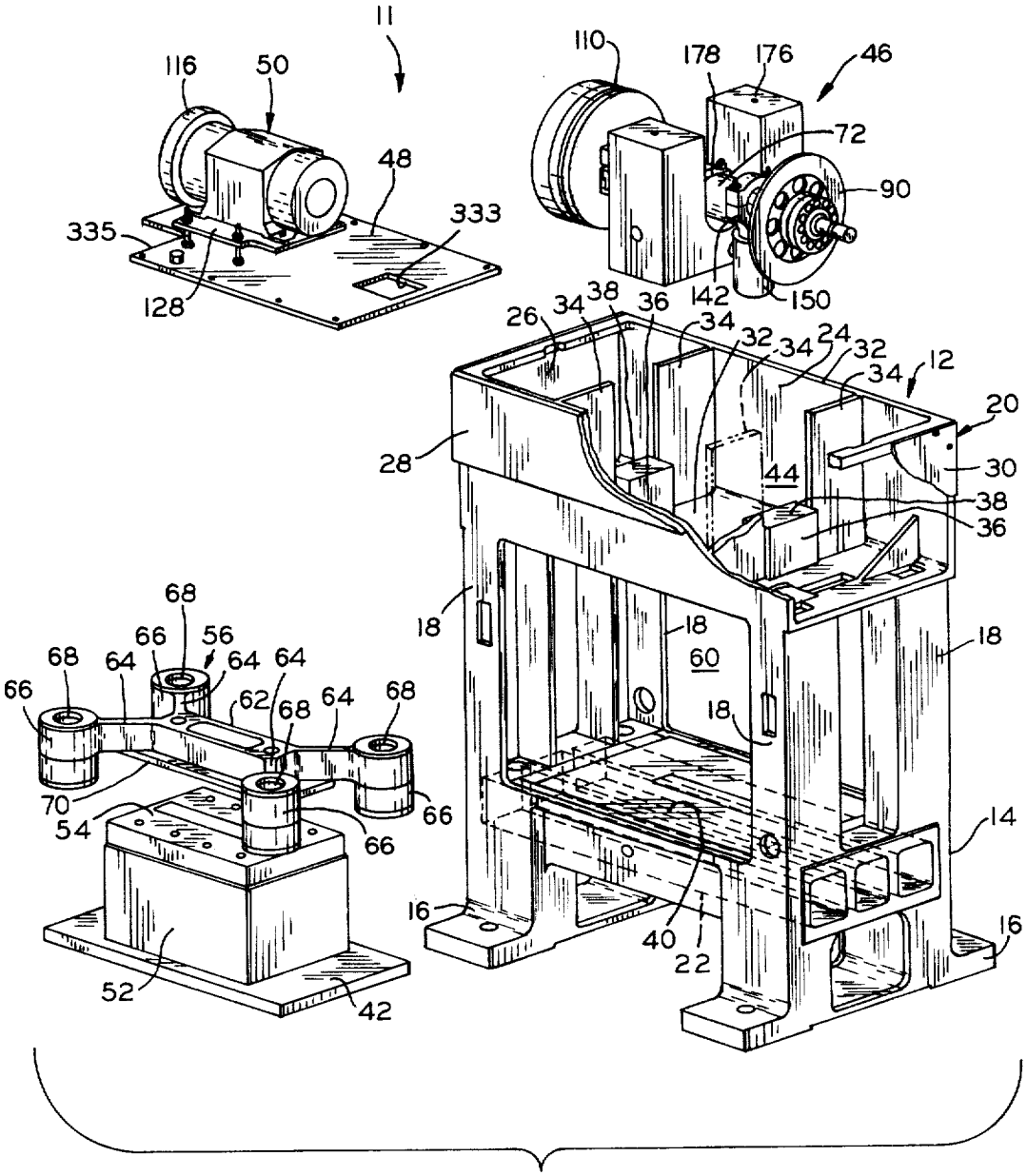
FIG. 1 is an exploded perspective view of the press according to the present invention.

FIG. 1 illustrates the press 11 of the present invention in exploded form, and it will be noted that the major subassemblies of the press are modular in nature. The press comprises a frame 12, which is a single casting and comprises a bed 14 supported on legs 16, four uprights 18 integral with bed 14 and extending upwardly therefrom, and a crown 20 integral with uprights 18. Bed 14 includes three horizontal chambers 22 extending laterally therein and being interconnected at their ends to form a single oil sump within bed 14. As will be described later, sump 22 receives the oil which has dripped through the thermal exchange devices on uprights 18 so that it can be pumped upwardly again to crown area 20.

Crown 20 comprises sides 24 and 28 and removable doors 26 and 30 and a bottom 32 integral with sides 24 and 28. It will be noted that the crown 20 terminate in an upper edge 32 so that the top of crown 20 is open. Vertical web-like partition members 34 are also integral with sides 24,28 and bottom 32. A pair of bearing support pads 36 are integral with partition elements 34 and bottom 32 and each include a very accurately machined bearing block support surface 38 which is parallel with the surface 40 of bed 14 on which bolster plate 42 is mounted. The sides 24–30 and bottom 32 of crown 20 together define the crank chamber indicated as 44.

As will be described in greater detail at a later point, crown 20 is open in the upward direction so that the drive assembly 46 can be inserted vertically therein in a completely assembled form as a modular subassembly. After the drive assembly 46 is in place, coverplate 48 is bolted to crown 20 and motor assembly 50 is mounted thereon.

Bolster plate 42 to which bolster 52 is mounted is bolted to the upper surface 40 of bed 14, in a manner to ensure that the upper surface 54 of bolster 52 is absolutely parallel to the bearing block support surfaces 38 of bearing support pads 36 in crown 20. In a manner well known in the art, bolster 54 is adapted to have the lower half of the die set (not shown) mounted thereto.

Figure 6:
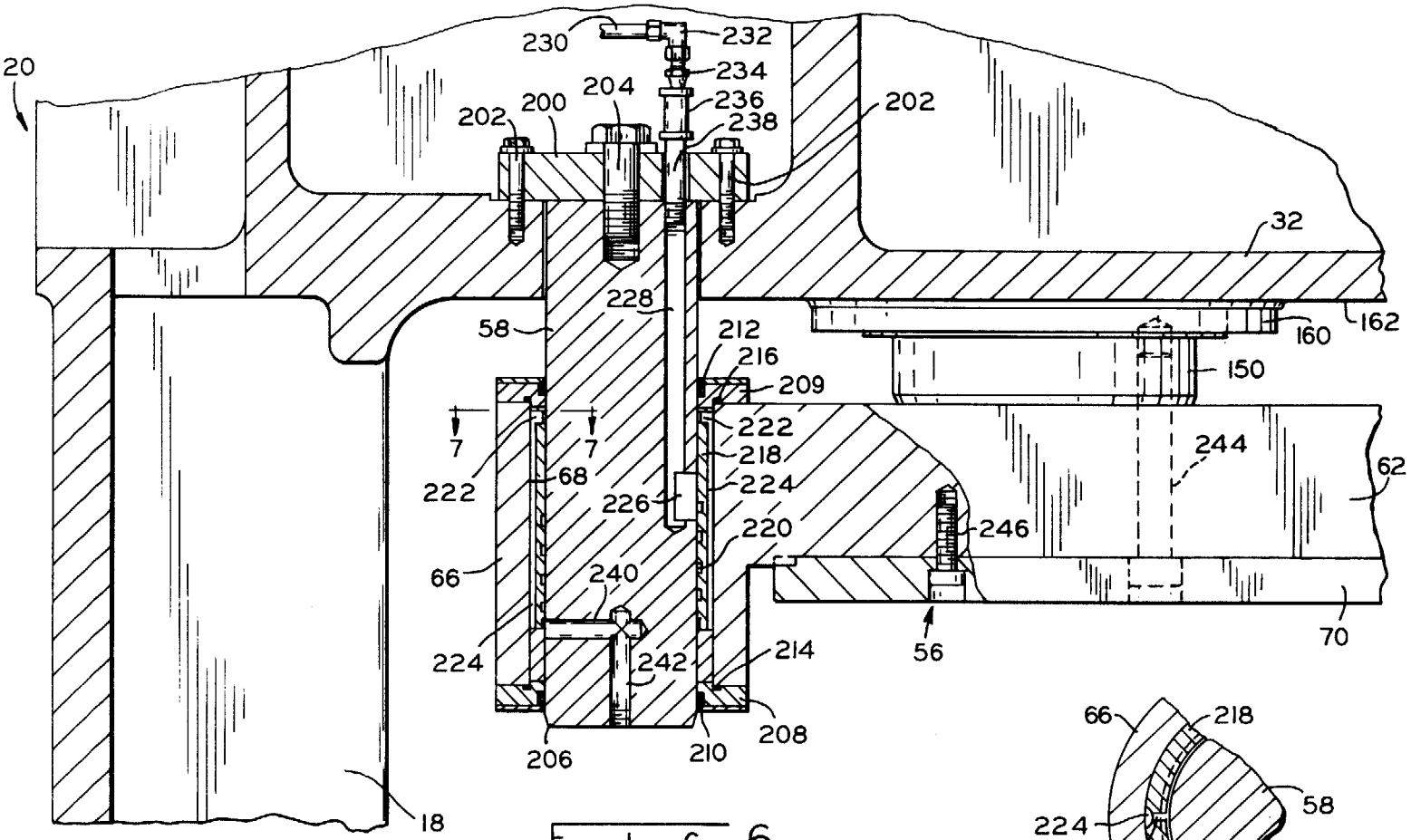
FIG. 6 is a fragmentary sectional view of the slide and guidepost assembly.

Slide 56 is mounted on four guideposts 58 (FIG. 6) that are rigidly connected to and depend downwardly from crown 20 and is adapted to slide over the guideposts in a rectilinear manner within the opening 60 between crown 20 and bolster 54 and between the left and right pairs of uprights 18. Slide 56 comprises a center portion 62, four web members 64 extending outwardly therefrom in a horizontal direction, and four bushing assemblies 66 integrally connected to web members 64. Web members 64 are relatively thin in relation to their height so that the mass of the slide 56 can be maintained as low as possible yet there is sufficient stiffness and rigidity to resist deformation in the vertical direction. By way of example, web members 64 could have a thickness of 2.5 inches and a height of 5.5 inches. The bushing assembly 66 each comprises an opening 68 extending completely therethrough and adapted to receive and be guided by guideposts 58 (FIG. 6). A slide plate 70 is removably mounted to the lower surface of slide 56 and includes a drill hole pattern suitable for the particular die set used.

Referring now to FIGS. 2 through 5, the drive assembly 46 will be described in greater detail. Drive assembly 46 comprises a crankshaft 72 having three eccentrics 74, 76 and 78 thereon, crankshaft 72 being rotatably supported within main bearing blocks 80, which are supported on the upper support surfaces 38 of pads 36. Bearing blocks 80 are of the split type and each comprise a cap 82 connected to the lower portion thereof and to pads 36 by bolts 84. Main bearings 86 are mounted within bearing blocks 80 and the portions 88 of crankshaft 72 are journaled therein.

Figure 2:
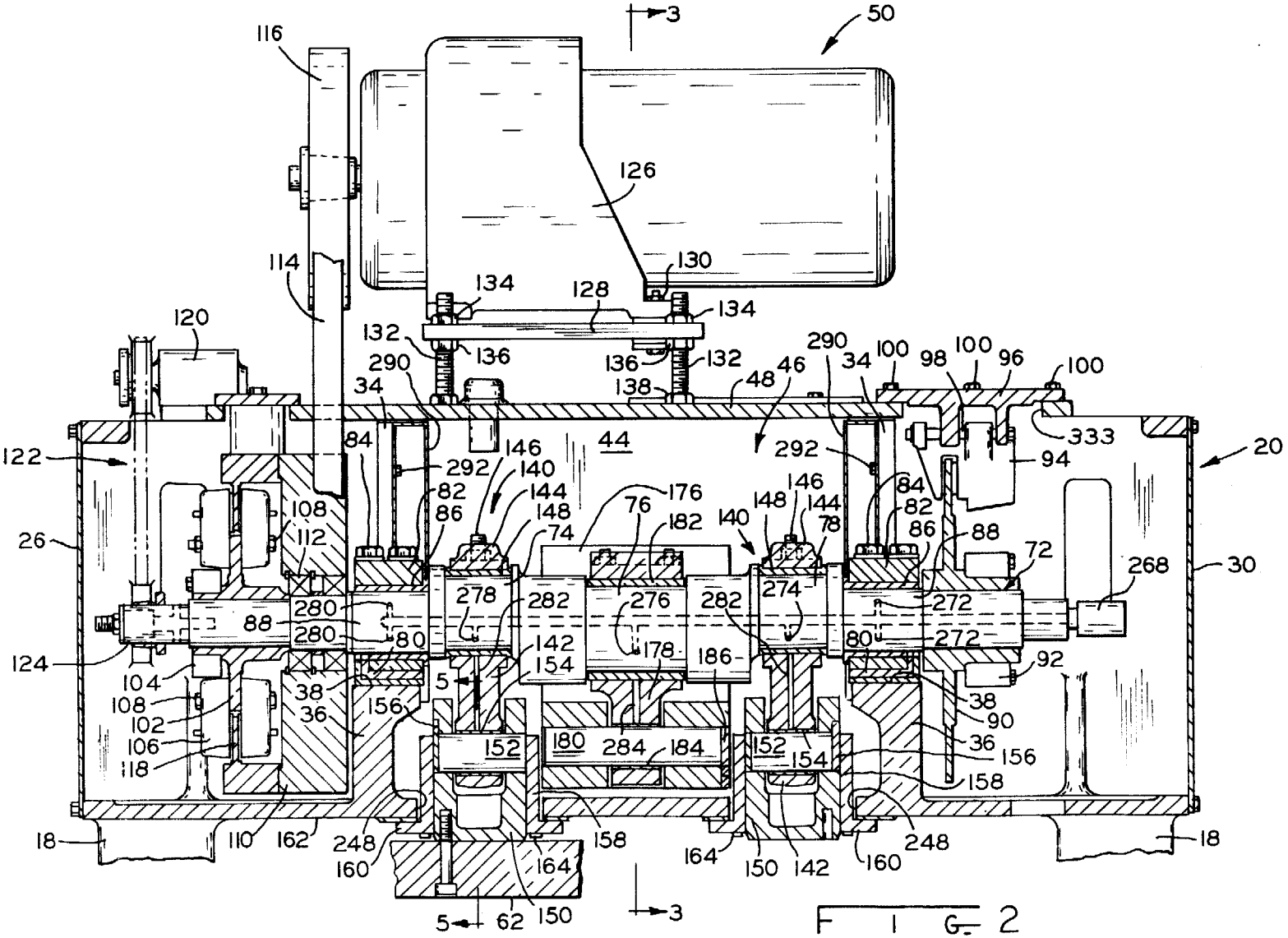
FIG. 2 is a sectional view of the crown and drive assembly of the press.

A brake disc 90 is frictionally mounted to the rightmost end of crankshaft 72 as viewed in FIG. 2 by means of Ringfeder 92, and a brake caliper 94 is mounted to bracket 96 by stud and nut assembly 98 such that it engages brake disc 90 when energized. Bracket 96 is connected to cover plate 48 by screws 100.

Still referring to FIG. 2, a clutch hub 102 is frictionally clamped to crankshaft 72 by Ringfeder 104, and has a plurality of calipers 106 rigidly connected thereto by bolts 108. A flywheel 110 is rotatably supported on crankshaft 72 by bearings 112 and is driven by a flat belt 114. Belt 114 is disposed around motor pulley 116, which is driven by motor 50. When motor 50 is energized, flywheel 110 constantly rotates but does not drive crankshaft 72 until clutch calipers 106 are energized. At that time, the friction disc 118 of flywheel 110 is gripped and the rotating motion of flywheel 110 is transmitted to crankshaft 72 through calipers 106 and hub 102. Solid-state limit switch 120 is driven by a pulley and belt arrangement 122 from the end of crankshaft 72 and controls various press functions in a manner well known in the art. Rotary oil distributor 124 supplies oil to the left end of crankshaft 72.

Motor 50 is connected to cover plate 48 by means of bracket 126 connected to mounting plate 128 by bolts 130, plate 128 being connected to cover plate 48 by studs 132 and lock nuts 134, 136, and 138, The tension on belt 114 can be adjusted by repositioning plate 128 on studs 132 by readjusting the positions of lock nuts 134 and 136 along studs 132.

In the preferred embodiment, the drive assembly 46 comprises two connection assemblies 140 each comprising a connection arm 142 having a connection cap 144 connected thereto by stud and nut assembly 146. Bearings 148 are disposed between the respective connection arms 142 and the eccentrics 74 and 78 of crankshaft 72. Connection assemblies 140 are similar to those disclosed in U.S. Pat. No. 3,858,432, which is owned by the assignee of the present application, and comprise pistons 150 rotatably connected to connection arms 142 by wrist pins 152 and bearings 154. Keys 156 lock wrist pins 152 to pistons 150.

Figure 4:
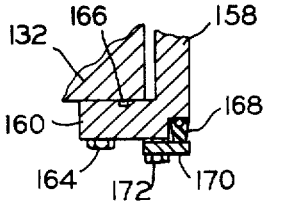
FIG. 4 is an enlarged fragmentary view of the sealing arrangement for the pistons and cylinders.

Pistons 150 are slidably received within cylinders 158, the latter including flanges 160 connected to the lower surface 162 of crown 20 by screws 164 and sealed thereagainst by O-rings 166 (FIG. 4). Seals 168 provide a sliding seal between pistons 150 and their respective cylinders 158 and are held in place by seal retainers 170 and screws 172 (FIG. 4).

The press 11 is dynamically balanced to counteract the movement of connection assemblies 140 and slide 62 by means of a balancer weight 176 connected to the eccentric 76 of crankshaft 72 by counterbalance connection arm 178 and wrist pin 180. Bearings 182 and 184 have eccentric 76 and wrist pin 180, respectively, journaled therein, and key 186 locks wrist pin 180 to weight 176.

Figure 3:
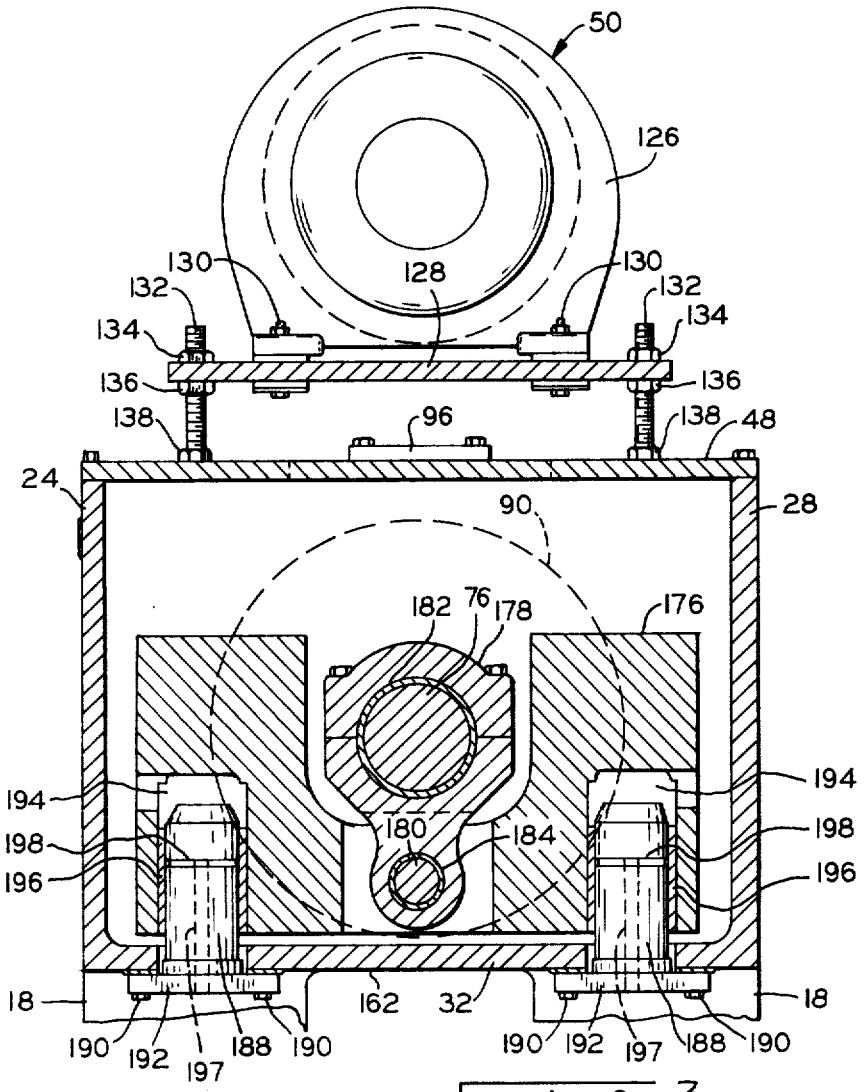
FIG. 3 is a sectional view taken along line 3—3 of FIG. 2 and viewed in the direction of the arrows.

Referring to FIG. 3, it will be seen that weight 176 is guided by means of a pair of guide pins 188 connected to the lower surface 162 of crown bottom 32 by screws 190 extending through flange portions 192. Guide pins 188 are received within openings 194 and guided by bearings 196. An axial passageway 197 conducts lubricating oil to groove 198 in order to lubricate the interface between pins 188 and their respective bearings 196. It will be seen that the position of eccentric 76 relative to eccentrics 74 and 78 on crankshaft 72 is 180° out of phase so that weight 176 moves rectilinearly in the opposite direction as pistons 150 and slide 62 in order to dynamically balance the press. Pins 188 are parallel to guideposts 58 so that slide 62 and weight 176 move in opposite directions vertically.

Figure 7:
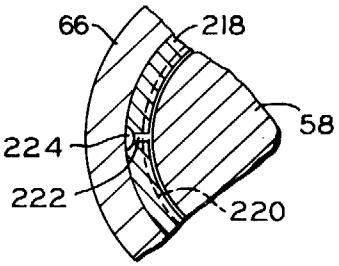
FIG. 7 is a sectional view taken along line 7—7 of FIG. 6 and viewed in the direction of the arrows.

Referring now to FIGS. 6 and 7, the guiding of slide 62 will be described. Four guideposts 58 are rigidly connected to the bottom 32 of crown 20 by means of flanges 200, with screws 202 connecting flanges 200 to crown 20 and screws 204 connecting guideposts 58 to flanges 200. There are four such guideposts connected to crown 20 in a symmetrical pattern in alignment with the openings 68 in bushing portions 66 of slide 56, and it will be noted that, unlike prior mechanical presses, guideposts 58 have distal ends 206 which terminate short of bed 14. In prior art mechanical presses, it is more common to utilize tie rods extending from the crown to the bed on which the slide is guided, or the slide is guided by gib surfaces fastened to the corners of the uprights. As discussed earlier, the relatively short extension of guideposts 58 and the fact that they are connected only to the crown 20 is advantageous in ensuring that they are parallel to each other, a condition which is imperative if slide 56 is to move perpendicularly relative to bolster 52.

A pair of seal plates 208 and 209 are connected to the upper and lower ends of bushing portions 66 and contain seals 210 and 212 and O-rings 214 and 216, respectively. Bearings 218 having a spiral groove 220 therein are received within openings 68 in bushing portions 66 of slide 56 and serve to establish oil films between them and the outer surfaces of guideposts 58 as slide 56 reciprocates. A pair of radial passages 222 are connected with a pair of axial passages 224, and oil is supplied to spiral groove 220 through slot 226 from axial passage 228. Oil is supplied to passage 228 from hose 230 through fittings 232, 234, 236 and nipple 238, and is conducted away from guideposts 58 through drains 240 and 242.

Slide 62 is connected to the protruding ends of pistons 150 by screws 244 extending through the central portion 62 of slide 56, and slide plate 70 is connected to the slide center portion 62 by screws 246. As shown in FIG. 2, pistons 158 extend through openings 248 in the bottom 32 of crown 20.

As crankshaft 72 rotates, connection arms 142 reciprocate pistons 150 within cylinders 158 along axes parallel to the axes of guideposts 58. Although guideposts 58 guide slide 56 with very close tolerances, a front-to-back tilting problem has been observed in connection with slide 56 as it is reciprocated. As the eccentrics 74 and 78 of crankshaft 72 move beyond their top dead center positions, they transmit to pistons 150 not only a component of force in the vertical direction, but also a horizontal component which, due to the rigid connection between pistons 150 and slide 56, tends to cause slide 56 to tilt about a horizontal axis parallel to the axis of crankshaft 72. Not only does this tilting movement of slide 56 result in accelerated wear of the guide bearing surfaces, but can result in unsatisfactory performance of the press in precision forming and stamping operations.

Figure 5:
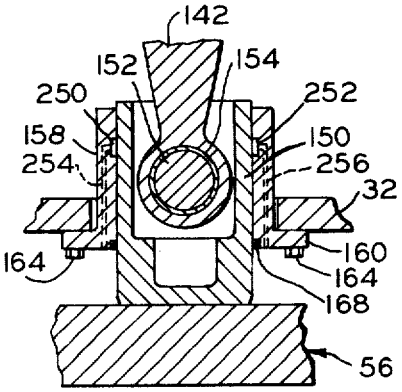
FIG. 5 is a sectional view taken along line 5—5 of FIG. 2 and viewed in the direction of the arrows.

In order to counteract this tilting force precisely at the point that is is exerted on pistons 150, a pair of hydrostatic bearings 250 and 252 are provided in cylinders 158 at positions directly opposite each other in a front-to-back direction intersecting the axis of pistons 150 and lying along lines which are intersected by the respective wrist pins 152 as pistons 150 are reciprocated. This relationship is illustrated in FIG. 5 wherein the slide is shown in its bottom dead center position. Fluid is supplied to hydrostatic bearings pockets 250 and 252 through passages 254 and 256, respectively. The pressurized hydraulic fluid exerted at the four points shown resist the tendency of pistons 150 to tilt in the front-to-back direction, and because the hydrostatic forces applied in the area of the wrist pins 152, the maximum resistive effect of the forces is realized.

Figure 8:
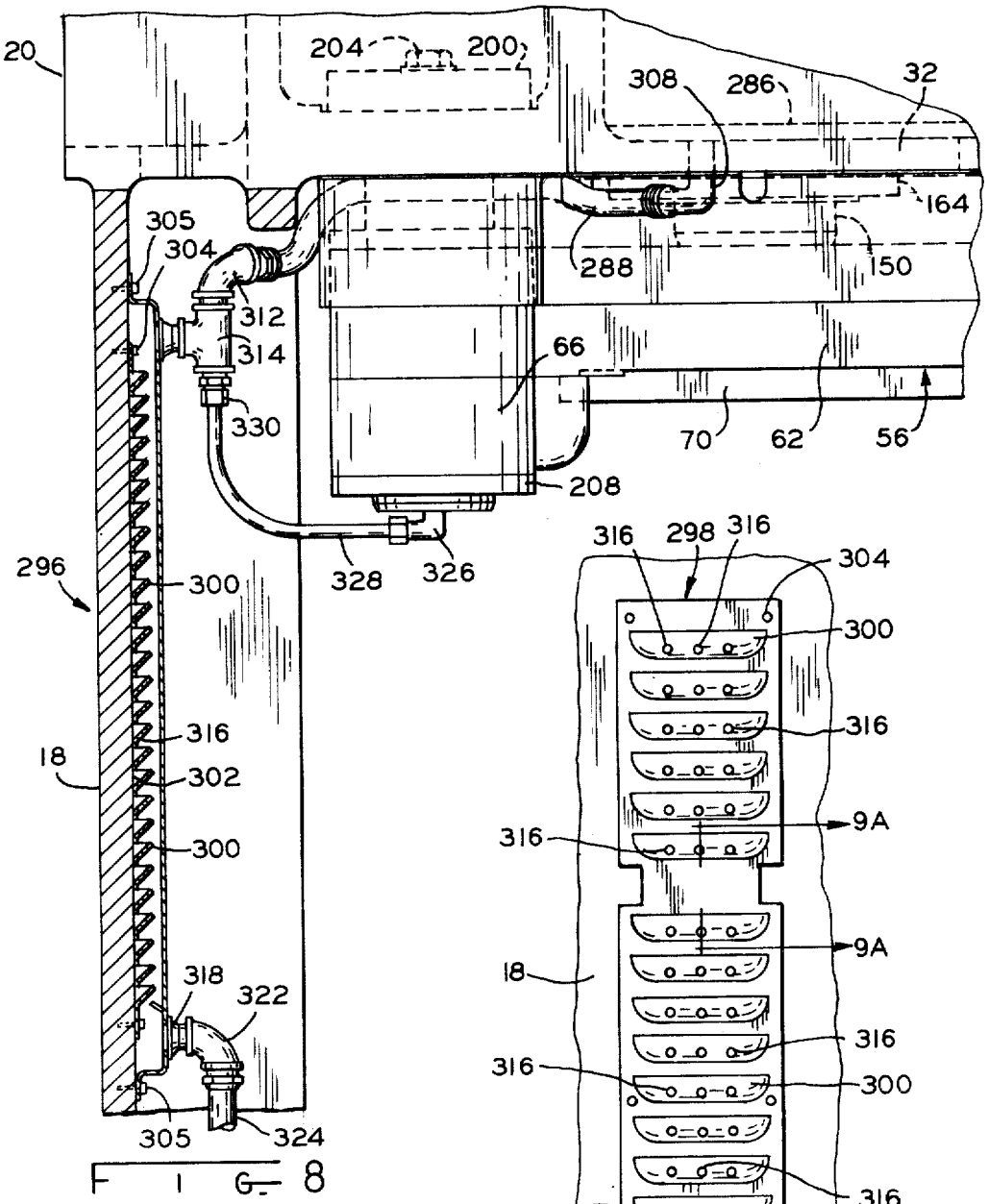
FIG. 8 is a sectional view of one of the thermal exchange devices.
Figure 9A:
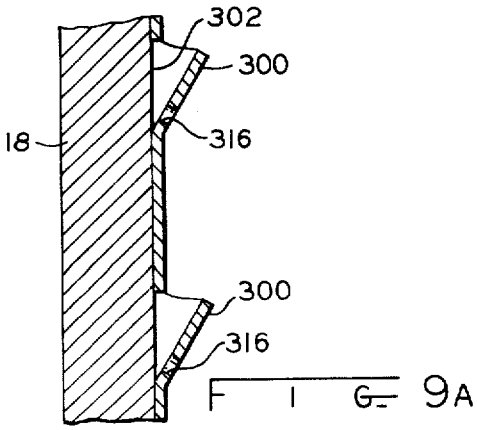
FIG. 9A is a sectional view of FIG. 9 taken along line 9A—9A.
Figure 9:
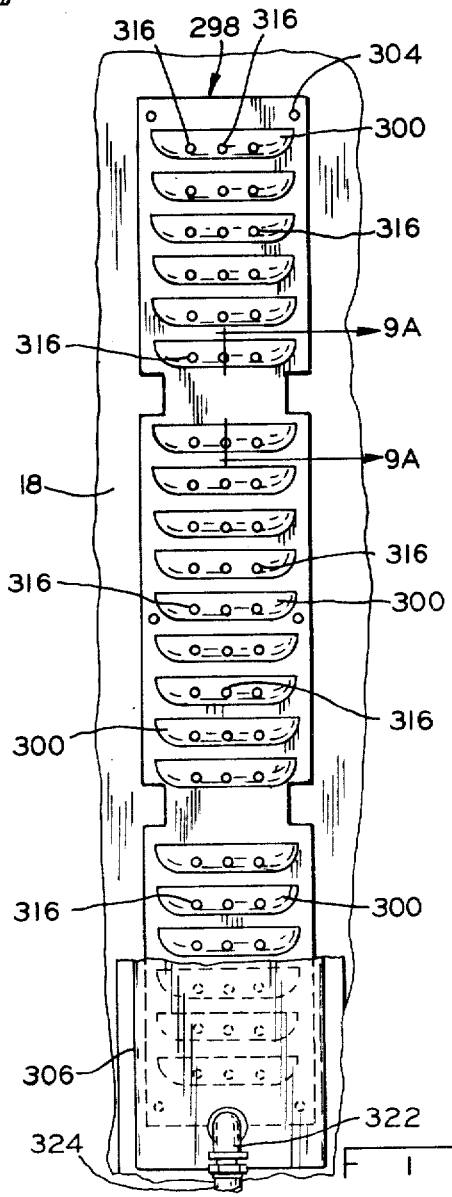
FIG. 9 is a front elevational view of the baffle plate.
Figure 10:
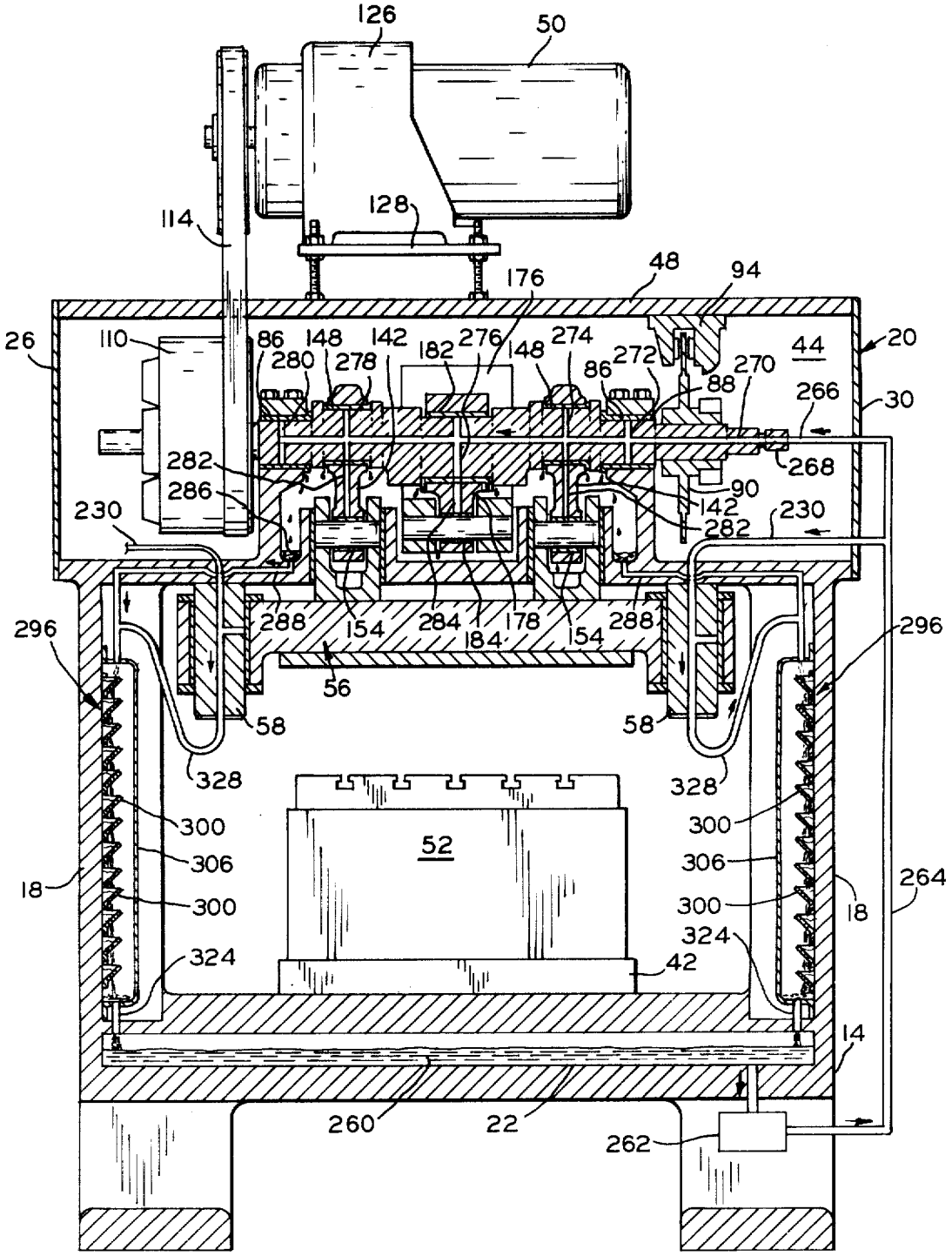
FIG. 10 is a diagrammatic view of the press showing the oil recirculation system.

With reference now to FIGS. 2, 6, 8, 9 and 10, the oil distribution and thermal stability system of the press will be described. As shown in FIG. 10, the lubricating oil 260 collects in sump 22 in bed 14 and is pumped by pump 262 upwardly through fluid line 264 to crown 20. Fluid line 266 connects to rotary oil distributor 268 that has an outlet connected to an axial passageway 270 in crankshaft 72. The oil flows from axial passageway 270 to bearing 86 through radial passages 272 in crankshaft 72, to bearing 148 through axial passages 274, to bearing 182 through axial passages 276, to bearing 148 through axial passages 278, and to bearing 86 through axial passages 280. Oil is supplied to wrist pin bearings 154 and 184 through passages 282 in connection 142 and passage 284 in dynamic balancer connection 178. The oil, which picks up heat from the drive assembly drains downwardly and is collected in a very shallow sump 286 within crown 20 and is drained therefrom through hoses 288. As shown in FIG. 2, a pair of sheet metal oil guards 290 are connected to partition members 34 and sealed thereagainst by seals 292. Guards 290 serve to seal the central portion of crank chamber 44 and permit all of the oil to be collected in its sump 286.

In order to compensate for the thermal growth of connections 142 due to the frictional heat generated as press 11 operates, heat is imparted to uprights 18 by means of circulating the oil from crown 20 through four thermal exchange devices 296 mounted on each of the uprights 18. In order that the uprights 18 elongate at the same rate as the connection assemblies 140 so that a constant shutheight is maintained, it is necessary that the following relationship be satisfied:

$$L_c dT_c a_c = L_u dT_u a_u$$

wherein $L_c$ is the length of the connections 142, $dT_c$ is the change in temperature of the connections 142, $L_u$ is the length of the uprights 18, $dT_u$ is the temperature change of the uprights, and $a_c$, $a_u$ are the coefficients of thermal expansion. What must be done is to impart the proper amount of heat per unit time to uprights 18 so that their change in temperature per unit time is proper to balance the equation given the change in temperature of the connections 142.

The thermal exchange device for accomplishing this according to the preferred embodiment of the invention is shown in detail on FIGS. 8 and 9 and comprises a stamped baffle plate 298 made of a material which may be a good thermal conductor, such as aluminum, or even a poor thermal conductor, such as molded plastic. Baffle plate 298 has a plurality of baffles 300 formed therein each adapted to hold a small pool of the hot oil drained from crown 20. Baffle plate 298 is mounted flush against the inner surface 302 of the respective upright 18 so that the individual baffles 300 cause the pools of oil to be held against the surface 302 of the upright 18. Baffle plates 298 are mounted to uprights 18 by screws 304. Also mounted to uprights 18 by screws 305 are four cover plates 306. Oil from sump 286 in crown 20 is conducted to the chambers formed between cover plates 306 and the inner surfaces 302 of the respective uprights by fitting 308, hose 288, fitting 312 and tee 314. Most of the oil is caught by the uppermost baffle 300 and held momentarily in contact with the inner surface 302 of respective upright 18. A plurality of holes 316 are formed in baffles 300 and cause the oil to drip from one baffle to the next so that the oil cascades down the baffles 300 of baffleplate 298 until it reaches outlet fitting 318. By means of this device, the hot oil from crown 20 is formed into a plurality of vertically spaced pools and held momentarily in contact with the upright so that a portion of its heat, which is the waste heat generated by friction in the crown 20, is imparted to the upright. The amount of heat which is transferred can be readily adjusted by varying the size of openings 316, by changing the spacing of baffles 300, by changing the size of baffles 300, and other possible alternatives. When the press is manufactured, the baffles plates 298 will be fine tuned so that the proper heat transfer occurs.

After the oil has drained through the heat transfer devices 296 and the uprights 18, it is conducted by fitting 322 and hose 324 to the sump 22 within bed 14.

Lubricating oil is pumped to guideposts 58 through hoses 230, fittings 232, 234, 236 and nipples 238 (FIG. 6), and the return oil is conducted to fitting 314 (FIG. 8) through fitting 326, hose 328 and fitting 330. Once the oil has reached sump 22, it is again circulated to crown 20 by pump 262 and hose 264. Thus, the oil is continuously recirculated to the crown wherein it picks up waste heat generated by the frictional forces in the drive assembly, waste heat generated by the frictional forces in the drive assembly, drains through the thermal transfer devices 296 on the uprights 18 whereupon the proper amount of heat is transferred to the uprights 18 so that they will thermally expand at the same rate as connections 142, and is collected in the sump 22 and bed 14 for recirculation to crown 20. The advantage to this type of thermal stabilization system over the prior art techniques of utilizing electric heaters is that there is a direct relationship between the temperature of the oil and the temperature of the connections, and by using this same oil to heat the uprights, the system can be fine tuned so that thermal expansion of the uprights 18 and connections 142 occurs at the same rate.

Figure 11:
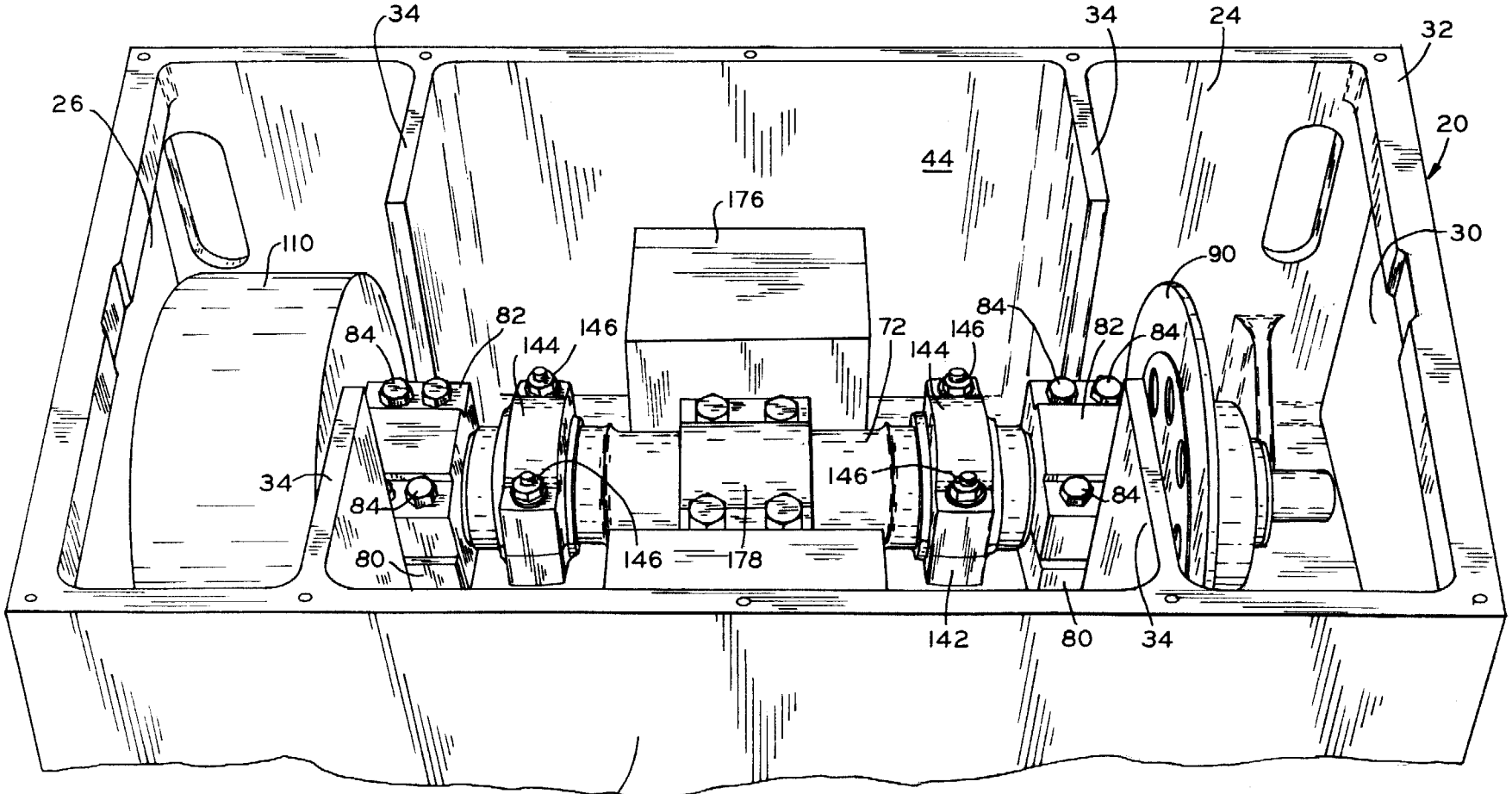
FIG. 11 is a top perspective view of the crown area of the press.

As alluded to earlier, press 11 is modular in nature and the major subassemblies thereof can be installed in preassembled form. This is particularly advantageous in connection with the drive assembly 46 comprising crankshaft 72 to which is attached the connections 142 and 178, pistons 150, weight 176, brake disc assembly 90, flywheel 110 and clutch caliper assembly 106, 102. Crown 20, which is integral with uprights 18, includes a drive assembly chamber 44 defined by sides 24, 26, 28 and 30 and bottom 32, and is open in the upward direction. When the entire drive assembly has been preassembled, it can be lowered into crank chamber 44 as shown in FIG. 1 to the position shown in FIG. 11. The lower portions of the main bearing blocks are first emplaced on the upper surfaces 38 of pads 36, the drive assembly is then lowered into place on the lower halves 80 of the bearing blocks, the top halves are emplaced and then fastened to the lower halves and to pads 36 by bolts 84.

After the drive assembly is in place, the cover plate 48 is attached to crown 20 and brake caliper and bracket assembly 94, 96, 98 is inserted through opening 333 to the position illustrated in FIG. 2, whereupon it is secured in place by screws 100. Motor assembly 50 is then mounted to cover plate 48. Limit switch 120 is driven by the pulley on the end of crankshaft 72, and the belt 122 extends into chamber 44.

As drive assembly 46 is lowered into crown chamber 44, pistons 150 are guided through openings 248 (FIG. 2) in crown 20 so that they protrude beyond the lower surface 162 of crown 20. Cylinders 158 can either be installed prior to the installation of drive assembly 46 or afterwards by pushing them upwardly through openings 248 and then holding them in place. Next, slide 56 is mounted to pistons 150 by screws which extend through the central portion 62 thereof. As the drive assembly 46 is lowered into chamber 44, the main bearing block portions 80, 82 pass between partition webs 34 (FIG. 1). The drive belt 114 from motor 50 to flywheel 110 extends through a notch 335 in top cover plate 48, which is shown in FIG. 1.

Side members 26 and 30 of crown 20 are removable so that the hydraulic connections and other adjustments can be made in connection with fluid unions 124 and 268. Bolster 52 and bolster plate 42 are mounted to bed 14 in the customary manner.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A mechanical press comprising: a bed; a crown; at least two uprights connecting the crown to the bed; a slide mounted for reciprocal movement between the crown and bed; a crankshaft and connection arm assembly mounted in the crown, said assembly comprising a rotatable crankshaft and at least one connection arm connected to said crankshaft and driven thereby; means for connecting said connection arm to said slide; means for circulating a lubricant in said crown into contact with said crankshaft and connection arm assembly whereby the lubricant is heated by frictional heat generated by the crankshaft and connection arm assembly; and thermal transfer means on said uprights for receiving the heated lubricant from the crown and transferring a portion of the waste heat in the lubricant to the uprights in an amount to cause the uprights to elongate due to thermal growth at approximately the same rate as the connection arms elongate due to thermal growth.

2. The press of claim 1 wherein said means for circulating lubricant in the crown comprises passageways in said crankshaft and connection arms, a pump means for pumping the lubricant through the passageways, and a lubricant sump in the crown.

3. The press of claim 2 wherein said thermal transfer means comprises a cascade baffle device mounted on each of the uprights having a plurality of vertically spaced baffles, and including a gravity flow fluid passage between said crown sump and said cascade baffle device.

4. The press of claim 3 including a lubricant sump in said bed connected to a lower portion of the cascade baffle device by a second gravity flow fluid passage.

5. The press of claim 1 wherein said thermal transfer means each comprises: a chamber wherein one wall of the chamber is defined by a surface of the respective upright, a lubricant cascade device comprising a plurality of vertically spaced baffle means adjacent said surface of the respective upright and forming with said surface a plurality of reservoirs each adapted to temporarily pool a small quantity of the lubricant against the surface of the upright and permit the pooled lubricant to drop to the next lower baffle means.

6. The press of claim 5 wherein said baffle means are in contact with the surface of the respective upright and include at least one opening through which the lubricant drips to the next lower baffle means.

7. The press of claim 6 wherein each of said baffle means forms an acute angle with the surface of the respective upright.

8. The press of claim 6 wherein said baffle means are made of a thermally conductive metal.

9. The press of claim 1 wherein said thermal transfer means comprises means associated with each upright for forming a plurality of pools of the lubricant received from the crown and means for causing the lubricant to flow from one pool to the next, said pools of lubricant being in good thermal contact with the respective upright.

10. The press of claim 9 wherein said means for forming pools of lubricant comprises a plurality of vertically spaced baffle means for holding the pools of lubricant directly against the surface of the respective upright and permitting the lubricant in the pools to drop by gravity to the next lower pool.

11. In a mechanical press having a crown, a bed, uprights connecting the crown and bed and a crankshaft and connection arm assembly for reciprocating a slide along a direction substantially parallel to the uprights, a method for preventing a change in press shutheight due to elongation of the connection arms as the press heats up comprising:

circulating a liquid lubricant in the crown over the crankshaft and connection arm assembly thereby causing the lubricant to absorb waste heat from the crankshaft and connection arm assembly, flowing the lubricant from the crown to a thermal transfer device on each of the uprights and causing a controlled amount of the waste heat absorbed by the lubricant from the crankshaft and connection arm assembly to be transferred to the uprights, the amount of heat transferred to the uprights being controlled so that the change in temperature of the uprights causes the uprights to elongate due to thermal growth at the same rate as the connection arms elongate due to thermal growth.

12. The method of claim 11 wherein the lubricant is contacted with the crankshaft and connection arm assembly by pumping the lubricant from a sump through passages in the crankshaft and connection arm assembly, collecting the heated lubricant in a sump in the crown, and causing the heated lubricant from the crown sump to flow under gravity to the thermal transfer devices.

13. The method of claim 11 wherein the heat lubricant from the crown is flowed by gravity through a series of vertically spaced pools of lubricant associated with the respective uprights wherein the pools are in good thermal contact with the respective upright.

14. The method of claim 13 wherein the lubricant in each pool is in direct contact with its respective upright.

15. The method of claim 13 wherein the thermal transfer device comprises a plurality of vertically spaced baffles which form the pools, the baffles each including at least one opening therein through which the lubricant flows from that baffle to the next lower baffle, and including the step of adjusting the amount of heat transferred to the uprights by adjusting the sizes of the openings thereby causing the lubricant to flow through the baffles at a higher or lower rate.

16. The method of claim 13 wherein the amount of heat transferred to the uprights from the pools of lubricant is adjusted by modifying the rate at which the lubricant flows through the series of pools.

17. The method of claim 13 wherein the thermal transfer device comprises a plurality of vertically spaced baffles which form the pools, the baffles each including openings therein through which the lubricant flows from that baffle to the next lower baffle, and including the step of adjusting the amount of heat transferred to the uprights by increasing or decreasing the number of openings in the baffles thereby causing the lubricant to flow from one baffle to the next at a higher or lower rate.

* * * * *